United States Patent [19]

Svensson

[11] 4,280,308

[45] Jul. 28, 1981

[54] LINTEL

[76] Inventor: Lennart Svensson, Tallbacken 2, Kungsbacka, Fed. Rep. of Germany, 43400

[21] Appl. No.: 72,636

[22] Filed: Sep. 6, 1979

[30] Foreign Application Priority Data

Sep. 8, 1978 [FR] France ..... 78 25836

[51] Int. Cl.[3] ..... E04B 1/00; E04C 2/08

[52] U.S. Cl. ..... 52/98; 52/97; 52/204; 52/215; 52/633

[58] Field of Search ..... 52/204, 215, 97, 98, 52/99, 633

[56] References Cited

U.S. PATENT DOCUMENTS

| | | | |
|---|---|---|---|
| 2,361,828 | 10/1944 | Drayer | 52/204 |
| 2,406,559 | 8/1946 | Oakes | 52/99 |
| 3,172,237 | 3/1965 | Bradley | 52/99 |
| 3,222,831 | 12/1965 | Pritchard | 52/99 |
| 4,106,247 | 8/1978 | Svensson | 52/204 |

FOREIGN PATENT DOCUMENTS

| | | | |
|---|---|---|---|
| 124271 | 5/1947 | Australia | 52/204 |
| 594378 | 3/1960 | Canada | 52/633 |
| 2533856 | 2/1976 | Fed. Rep. of Germany | 52/204 |
| 912586 | 4/1946 | France | 52/633 |
| 787643 | 12/1957 | United Kingdom | 52/204 |

*Primary Examiner*—Alfred C. Perham
*Attorney, Agent, or Firm*—Holman & Stern

[57] ABSTRACT

A lintel for supporting arches over doors, windows and other openings in a wall. The lintel is made of relatively thin sheet metal and has at least one load-carrying shank (5;12,13;19,20), so that the lintel in spite of its thin construction can carry great loads during the walling of the arch. The shank or each shank is provided with a longitudinally extending material weakening (6), e.g. a series of slots, perforations, a groove or similar. Said material weakening forms a fracture indication along which the shank can be folded or broken off, when the motar has set and brickwork has become self-supporting.

7 Claims, 7 Drawing Figures

LINTEL

BRIEF SUMMARY OF THE INVENTION

The present invention refers to a lintel for supporting oen or more courses at the walling of e.g arches over wall openings, brick facades and the like, and of the type consisting of a relatively thin sheet metal profile with at least one shank constituting the most load carrying part of the lintel.

Lintels bridging over wall openings are known with many different embodiments (e.g. DE-OS Nos. 1,966,687, 2,533,856). In order to make the lintel as little conspicious as possible it has been attempted to make lintels which at least partly can be placed in the joint between two bricks and therefore are made of relatively thin sheet metal. The requirement for a low structural height however has resulted in the angular momentum and the bending resistance being very small and the lintel therefore is capable of carrying only small loads. In order to improve the carrying capacity of such lintels tension bands or rods have been proposed (U.S. Pat. No. 4,106,247), which can be attached between the ends of the shanks of the lintel. By arranging these tension bands in the joints between the bricks they can be disguised. In many cases it is however not possible to use L- or Z-shaped profiles, when the load-carrying shank of the lintel can not be disguised or shall not be visible. The reasons for this can be many and technical well as aesthetical. A lintel above a door or window opening can e.g. not project several centimeter into the opening, since this space must be occupied by the window or door frame.

The purpose of the invention is to provide a lintel of the above mentioned kind, which has sufficient strength during the walling for supporting the brickwork, which has a low weight and therefore has an insignificant influence upon the load conditions, which can carry torsional forces caused by one-side loading of the lintel during the walling and which can be easily manufactured by bending of a thin sheet metal profile without complicated welding operations.

It is a purpose of the invention to provide a lintel of this kind, which in spite of its thin construction can carry great loads during the walling and which after the setting of the mortar will not form an obstruction between the bricks.

This has according to the invention been achieved by the fact that the shank, or each shank, is provided with a material weakening e.g series of slots, perforations, one or several grooves or acombination thereof extending in the longitudinal direction of the shank. The material weakening is so designed that the carrying capacity of the lintel in the plane of the shank is only insignificantly reduced thereby and, at the same time, the material weakening forms a fracture indication when bending the shanks along the line thereof.

DETAILED DESCRIPTION

Figure 1:
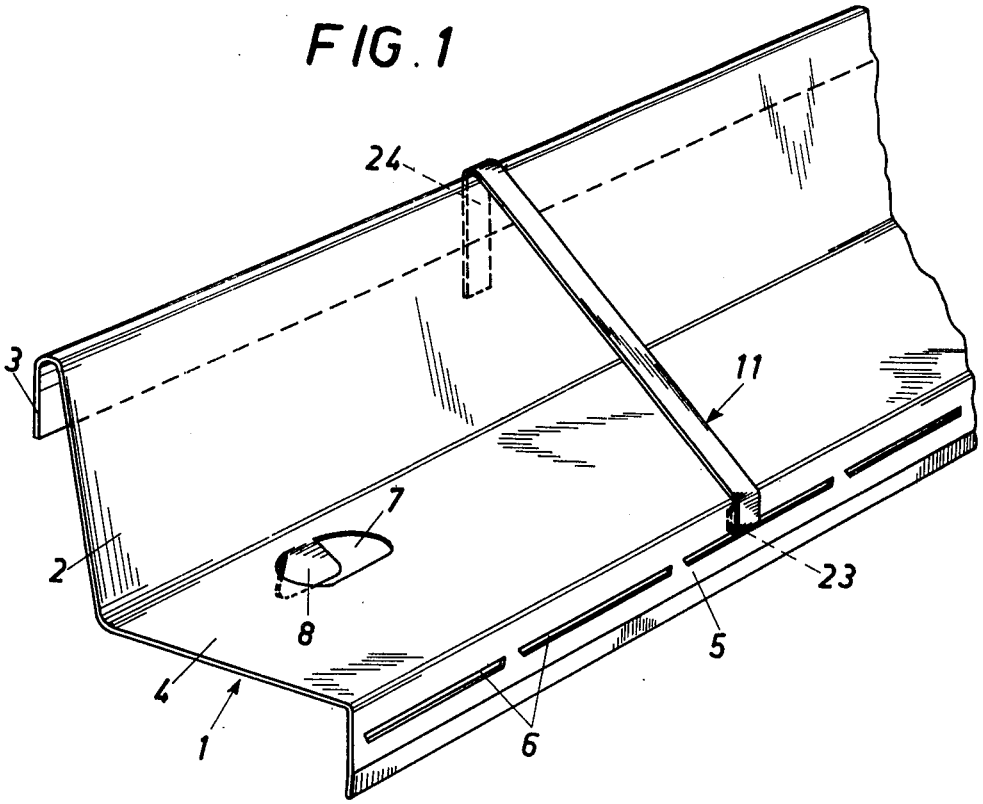
FIG. 1 is a perspective view of a lintel according to the invention.
Figure 2:
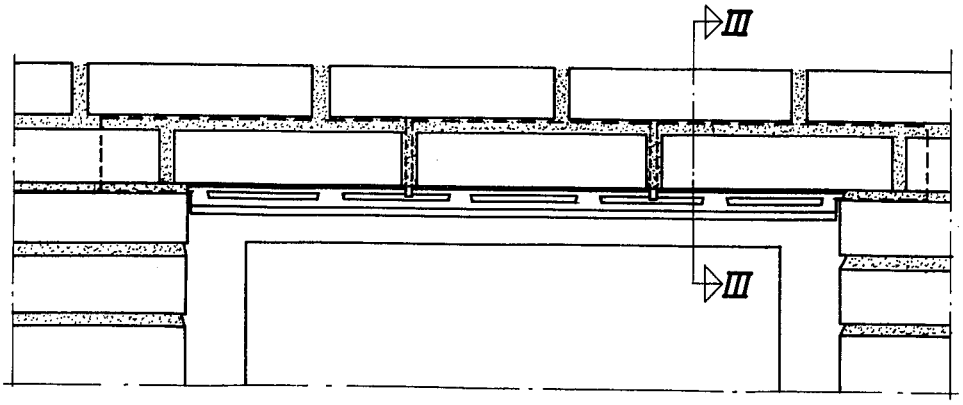
FIG. 2 is a front view of a wall with a wall opening provided with a lintel according to the invention.
Figure 3:
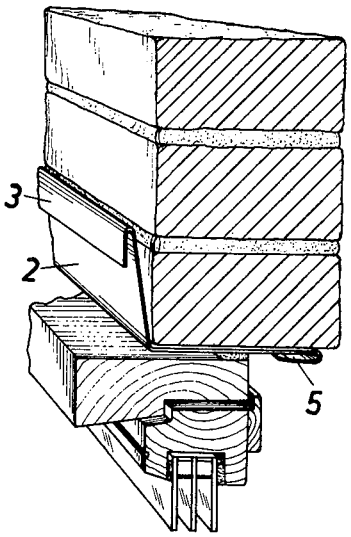
FIG. 3 is a perspective view of a lintel taken along section line III—III in FIG. 2.

The lintel 1 according to the embodiment shown in FIG. 1–3 comprises a thin plate profile with a substantially Z-shaped cross section, the first shank 2 of which comprises two parts 2,3 arranged at an angle to each other and having a cross-sectional shape of an inverted V. The angle between the central portion 4 and first shank 2 is larger than 90°, so that when the central portion 4 is horizontally placed the shank 2 inclines upwards/outwards. The inclined shank 2 can at the mounting of the lintel be brought to contact the body of a building with its second part 3, which is substantially perpendicular to the horizontal central portion 4.

The second shank 5 of the Z-profile is arranged substantially perpendicular to the horizontal central portion 4 and serves as a load-carrying stiffening flange during the walling and before the brickwork has achieved sufficient strength for being selfsupporting.

The second shank 5 is provided with a perforation extending in the longitudinal direction of the lintel. In the embodiment shown the perforation comprises slots 6 with narrow material portions in between and arranged in a row at some distance from the folding edge between the central portion 4 and the shank 5. The perforation is so designed that the carrying capacity of the lintel in the plane of the shank 5 is only insignificantly reduced. Also other types of material weakenings than perforations are possible, e.g. one or more grooves or a combination of slots and grooves. When the brickwork has become self-supporting the shank 5 can be manually folded inwards or broken off along the perforation. The remaining portion between the perforation and the bending between the middle portion 4 and the flange 5 serves as a throating.

The shank 5 can be stiffened by a bending of substantially 180° in its longitudinal direction as is shown in FIG. 1.

The horizontal central portion 4 of the lintel 1 is at some distance from the bending adjacent to the first shank 2 provided with punchings 7 forming a tip 8, which at three sides is surrounded by the punched portion 7 and thus forms a support against the ground work, if necessary. This can occur when the centre of gravity of the bricks located on the lintel is closer to the back edge of the lintel and a settling of the lintel is to be prevented.

A further stiffening of the lintel 1 can be achieved if tension bands 11 are applied between the first shank 2 and the second shank 5 at chosen positions along the lintel at least in some of the joints between the bricks in the first course. The tension band 11 consists of a flat strip, which at both ends is folded forming hooks 23,24 which can be hooked around the first shank 2 and to the second shank 5. Preferably the slots 6 serve as an attachment for the hook 23.

The lintel 1 is intended as a combined arch support and water discharger above a wall opening, e.g. a window or door opening, as is shown in FIG. 2.

Figure 4:
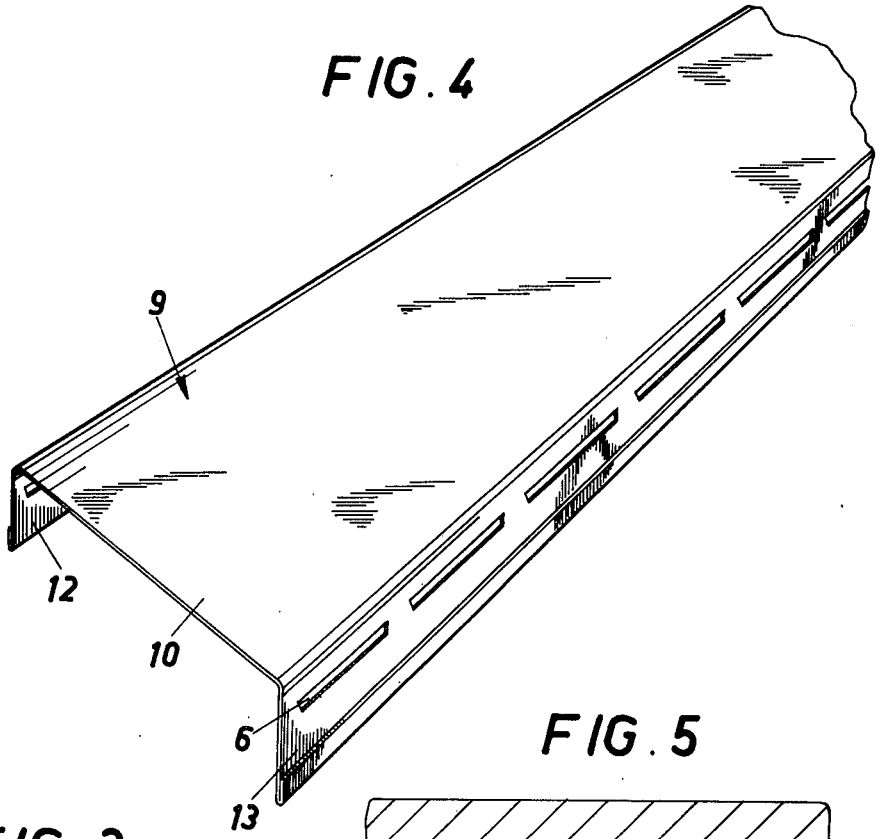
FIG. 4 is a perspective view of another embodiment of the invention.

At walls where an interior wall is missing the lintel shown in FIGS. 1–3 can not be used. In this case it is advisable to use a lintel 9 according to FIGS. 4 and 5. This lintel 9 has a substantially U-shaped cross-section and can be used for all types of brickwork, when the underside of the brickwork in the opening will be disguised by a door- or window frame or by grout.

Perforations are arranged along both shanks of the U-profile 12,13 at some distance from the folding edges between the middle portion 10 of the U-profile and the shanks 12,13.

When applying the lintel in the joint on the bearing surface cuts are made in the shanks 12,13 to the perforation, so that the shanks 12, 13 can be broken off along the perforations on the parts of the lintel which are to be walled up at the sides of the wall opening.

Figure 5:
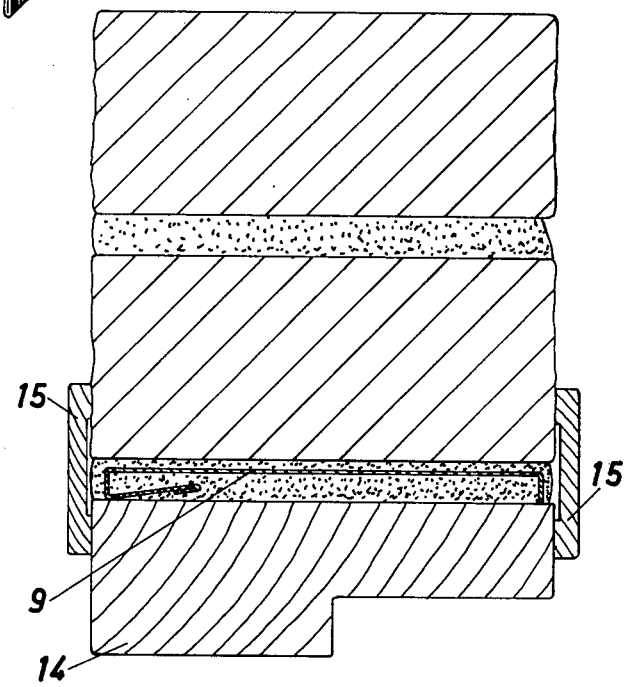
FIG. 5 is a cross-section view through a wall with a wall opening provided with the lintel according to FIG. 4.

When the arch has been walled and the brickwork has achieved sufficient strength for being self-supporting the shanks 12,13 are bent inwards or broken off along the perforation, in order to leave space for the door or window frame 14. In FIG. 5 both alternatives are shown. Dressings 15 are placed in front of the joint between the window frame 14 and the first course.

Figure 6:
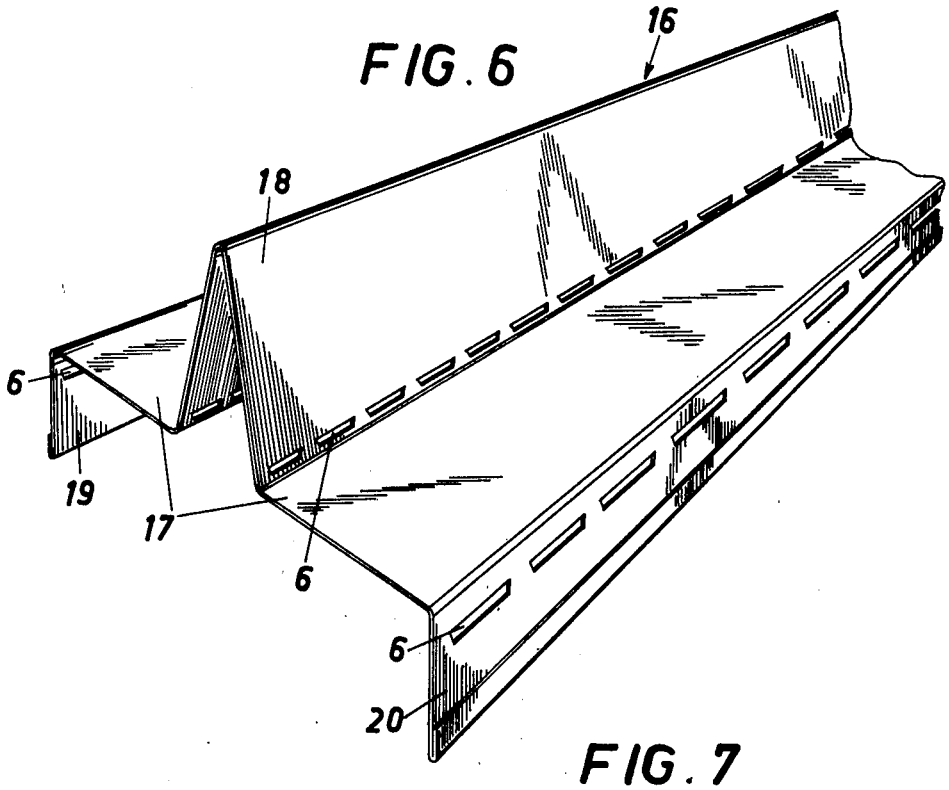
FIG. 6 is a perspective view of a further embodiment of the invention.
Figure 7:
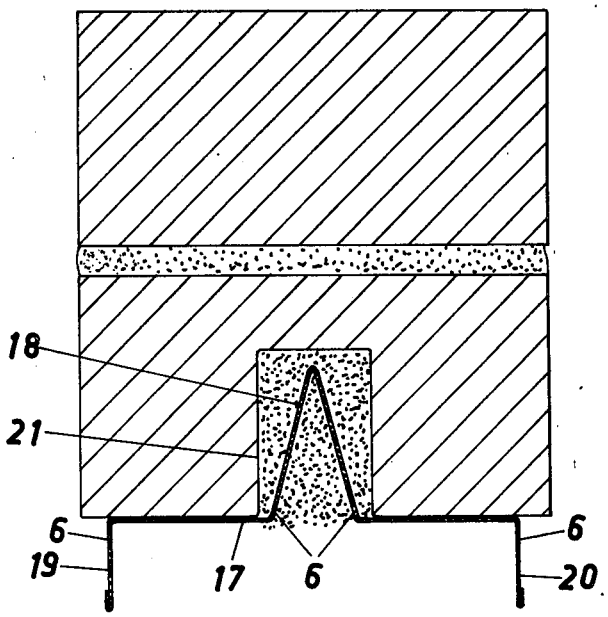
FIG. 7 is a section through a wall with a wall opening provided with the lintel according to FIG. 6.

The lintel 16 shown in FIGS. 6 and 7 is appropriate to use when the brickwork is not self-supporting and a reinforcement is necessary. The lintel 16 comprises a substantially U-shaped profile, which in its central portion 17 between the shanks 19,20 is designed with a longitudinally extending wedge-shaped portion 18. Perforations 6 are arranged close to each folding edge between the central portion 17 and the wedge-shaped portion 18 and along each shank 19,20 at some distance from the folding edge between the central portion 17 and the shanks The wedge-shaped portion 18 is intended to be placed in a groove 21 in the bricks, said groove being filled with mortar at the walling. When the brickwork has achieved sufficient strength one proceeds in one of the following ways:

(A) If the underside of the brickwork will be visible in the opening and shall be unprepared the lintel is broken along the perforations of the wedge 18 and only the wedge is left as a reinforcement of the brickwork.

(B) If the underside of the brickwork is disguised by a door- or window frame or by grout the lintel is bent inwards/backwards or is broken along the perforation of the shanks 19,20 in the same way as is shown in FIG. 5.

This type of reinforcement 18 is intended especially for large volume bricks as gas concrete bricks, light clinker bricks, concrete bricks, hollow concrete blocks etc.

All lintels are made of relatively thin sheet metal (e.g. 0.7–1.0 mm). It is however also possible to manufacture the lintel by expanded metal nets, where a material weakening can be obtained e.g. by weakening lines milled in the expanded metal.

The invention is of course not limited to the embodiments shown, but a number of modifications are possible within the scope of the claims.

I claim:

1. A lintel for supporting one or more courses of brick or the like at the walling of arches over wall openings, brick facades and the like, and of the type comprising a relatively thin sheet metal profile which is bent to form at least one shank constituting the most load carrying part of the lintel, each shank being provided with a material weakening comprising a series of slots, perforations, one or several grooves, or a combination thereof extending in the longitudinal direction of the shank and forming a fracture indication when the shank is bent along said material weakening for the purpose of folding back or breaking off the outer portion of said shank when the brickwork has become self-supporting, said material weakening being so designed that the carrying capacity of the lintel in the plane of the shank is only insignificantly reduced thereby.

2. A lintel as claimed in claim 1, wherein said material weakening is located in close proximity to a respective bending of the lintel.

3. A lintel as claimed in claim 1, wherein the material weakening is located at a distance from a respective bending of the lintel substantially corresponding to the thickness of a joint between bricks.

4. A lintel as claimed in claim 3 with a substantially Z-shaped cross-section and further comprising tension bands provided between the shanks in at least some of the butt joints between the bricks of the first course, wherein one end of each tension band is attached to one of the slots or the like of the material weakening.

5. A lintel as claimed in claim 1, wherein the central portion of the lintel near the bending between the central portion and the first shank is provided with punchings each forming a tip having a length mainly corresponding to the thickness of a joint, said tip being arranged to be foldable downwards in order to form a support in its perpendicular position relative to the central portion.

6. A lintel as claimed in claim 1, wherein the profile has a substantially U-shaped cross-section and each of the shanks of the U-profile is provided with a material weakening extending in the longitudinal direction thereof.

7. A lintel as claimed in claim 1 or 6, wherein the lintel has a substantially U-shaped cross-section with a triangular wedge-shaped portion projecting from the central portion between the shanks and in close spaced relation with each bending between said central portion and the wedge a material weakening is provided in said wedge extending in the longitudinal direction of the profile.

* * * * *